US005862641A

United States Patent [19]

Miskolczi, Jr.

[11] Patent Number: 5,862,641

[45] Date of Patent: Jan. 26, 1999

[54] KILN ANCHOR

[75] Inventor: John Miskolczi, Jr., Manvel, Tex.

[73] Assignee: LEA-CON, Inc., Houston, Tex.

[21] Appl. No.: 842,233

[22] Filed: Apr. 23, 1997

Related U.S. Application Data

[63] Continuation of Ser. No. 369,939, Jan. 6, 1996, abandoned.

[51] Int. Cl.[6] ..... F04B 1/38; F23M 5/03

[52] U.S. Cl. ..... 52/713; 52/379; 52/396.01; 52/513; 110/331; 110/336; 432/248; 432/252

[58] Field of Search ..... 52/713, 714, 344, 52/372, 378, 379, 479, 152, 346, 396.01, 513; 110/336, 331; 122/6 A, 6 R; 403/393, 400, 397; 432/248, 252

[56] References Cited

U.S. PATENT DOCUMENTS

| | | | |
|---|---|---|---|
| 814,949 | 3/1906 | Edgar . | |
| 915,195 | 3/1909 | Lemb . | |
| 1,106,725 | 8/1914 | MacCallum . | |
| 1,328,380 | 1/1920 | Laird . | |
| 1,569,197 | 1/1926 | MacCallum . | |
| 1,699,554 | 1/1929 | Wigglesworth . | |
| 1,713,516 | 5/1929 | Becker | 52/713 X |
| 1,934,760 | 11/1933 | Awbrey | 52/379 X |
| 1,946,083 | 2/1934 | Lambie . | |
| 1,978,077 | 10/1934 | Doyle et al. . | |
| 2,029,492 | 2/1936 | Lindner . | |
| 2,042,560 | 6/1936 | Stewart | 432/248 X |
| 2,249,799 | 7/1941 | Trainer . | |
| 2,263,848 | 11/1941 | Keaney | 432/248 |
| 2,288,372 | 6/1942 | Rump . | |
| 2,752,774 | 7/1956 | Steinboeck | 52/378 |
| 2,847,849 | 8/1958 | Reintjes . | |
| 2,903,876 | 9/1959 | Nannini . | |
| 3,302,356 | 2/1967 | Hinchlifle | 52/378 X |
| 3,315,950 | 4/1967 | Potocnik et al. | 110/336 |
| 3,328,014 | 6/1967 | Longenecker | 432/238 |
| 3,330,546 | 7/1967 | Bryan . | |
| 3,341,998 | 9/1967 | Lucas | 52/379 |
| 3,343,227 | 9/1967 | Brown et al. | 52/713 X |
| 3,362,698 | 1/1968 | Cerny et al. . | |
| 3,376,681 | 4/1968 | Demaison . | |
| 3,377,764 | 4/1968 | Storch | 52/713 |
| 3,431,693 | 3/1969 | Stephens . | |
| 3,633,890 | 1/1972 | Kozmin . | |
| 3,731,446 | 5/1973 | Wallace . | |
| 3,812,798 | 5/1974 | Merkle, Jr. . | |
| 3,834,099 | 9/1974 | Haecussler | 52/378 |
| 3,869,247 | 3/1975 | Duessner . | |
| 4,015,929 | 4/1977 | Kamstrup-Larsen . | |
| 4,083,752 | 4/1978 | Bielski et al. . | |

(List continued on next page.)

FOREIGN PATENT DOCUMENTS

| | | | |
|---|---|---|---|
| 604659 | 10/1934 | Germany . | |
| 0920096 | 9/1954 | Germany | 52/713 |
| 3443933 | 5/1986 | Germany . | |
| 4007662 C1 | 5/1991 | Germany . | |
| 882745 | 3/1960 | United Kingdom . | |
| 1 386 407 | 3/1972 | United Kingdom . | |

*Primary Examiner*—Carl D. Friedman
*Assistant Examiner*—Winnie S. Yip
*Attorney, Agent, or Firm*—Arnold White & Durkee

[57] ABSTRACT

An anchor for connecting refractory material to a wall or other support structure for a kiln or other vessel is disclosed. The anchor includes a first member having a section along its length that is selectively configured and has a selective cross-sectional shape. The anchor includes a second member having a complementary engaging section. The complementary engaging section has a cross-sectional shape and dimension complementary to the selected configuration of the length of the first section of the first member. The complementary engaging section of the second member further has a selective configuration along its length complementary to the shape and dimension of the selective cross-sectional shape of the first section of the first member such that the two members complementarily engage to enhance heat transfer, while at the same time permitting relative rocking and rotational movement of the members in use.

18 Claims, 3 Drawing Sheets

U.S. PATENT DOCUMENTS 4,122,642 10/1978 Buchy .
4,151,693 5/1979 Harvey .
4,194,337 3/1980 Fischer ..... 52/713
4,291,514 9/1981 Harvey .
4,389,189 6/1983 Harvey et al. .
4,508,504 4/1985 Eschmann et al. .
4,529,178 7/1985 Hosbein et al. .
4,569,659 2/1986 Olsen et al. .
4,668,183 5/1987 Patterson .
4,875,319 10/1989 Hohmann .
4,977,838 12/1990 Farrell et al. .
5,060,428 10/1991 Arthur, Jr. et al. .
5,117,604 6/1992 Bly et al. .

KILN ANCHOR

This is a continuation of application Ser. No. 08/369,939, filed Jan. 6, 1996. Now abandoned.

BACKGROUND OF THE INVENTION

The invention relates to wall construction systems for refractory furnaces and kilns, and more specifically, it relates to an improved anchoring system for the inner refractory walls of such refractory furnaces and kilns.

Over the years, numerous systems have been used for anchoring the refractory material used in furnaces and kilns to the outer support structures of the furnaces and kilns. For example, in U.S. Pat. No. 3,376,681, there is disclosed a furnace wall construction having a series of retaining blocks that have embedded therein metallic reinforcing means formed with fastening elements tied to the outer furnace supporting surface. Also, in U.S. Pat. No. 3,731,446, there is disclosed a suspended roof or wall system that includes blocks formed or provided with hanger bars that extend into the blocks. The hanger bars in turn are connected to the support structure for supporting the blocks.

Still further, in British Patent Specification 1,386,407, there is disclosed an anchor for refractory lining that comprises two separate V-shaped members. One member has two holes and is secured to a structure such as a shell or frame. The second member extends through the holes in the first member and has arms that extend divergently away from the first member and are embedded in the refractory material for holding the refractory material.

While the above anchoring systems may be adequate to secure the refractory material under most applications, it is believed that the above systems do not optimize the ability of such systems to transfer and dissipate heat encountered by the anchor. Additionally, it is believed that such anchoring systems fail to provide the full range of movement that may be necessary due to expansion and contraction of the refractory material in use. Accordingly, it is desirable to provide an anchoring system that maximizes heat transfer and dissipation through the anchoring system and also maximizes the flexibility of movement of the anchoring system.

SUMMARY OF THE INVENTION

The present invention provides such an anchoring system through the provision of an anchor for connecting refractory material to a wall for a kiln or other vessel that includes a first member adapted to be securable to such a wall and a second member adapted to interconnect with the first member and to be embedded in the refractory material. The first member of the anchoring system includes a first section that is arcuate along its length and that is arcuately shaped in cross section. The second member has an engaging section having a cross sectional shape and dimension complementary to the arcuate shape of the length of the first section of the first member. The engaging section further has an arcuate shape along its length complementary in shape and dimension to the arcuately shaped cross section of the first section of the first member such that the first and second members may be complimentarily engaged with each other to allow limited rocking and rotational movement relative to each other in all directions, while also maximizing surface area contact between the two members.

The anchor of the present invention thereby maximizes heat transference and heat dissipation because of the enhanced surface area contact between the first member and the second member. That is, the second member, which is embedded in the refractory member in use, will receive heat from the refractory material in which it is embedded. Because the surface area contact between the first member and second member is enhanced, the transference of heat from the second member to the first member will also be enhanced so that the heat may be passed through the first member to the support structure for dissipation of the heat.

In an alternative embodiment of the present invention, the second member has a roughly rectangular cross sectional shape and is further curved along its length to have an arcuate configuration complementary to the arcuate cross sectional shape of the first section of the first member. This embodiment accommodates the use of flat bar for the second member while still enhancing the surface area contact between the first member and second member to also enhance heat transfer and dissipation.

In another aspect of the present invention, the first member may comprise at least one heat transfer section adapted for conducting heat away from the fastening member toward the wall. The surface area of the heat transfer section is adapted to provide increased contact between the wall and the heat transfer section so that transfer of heat through the first member to the wall is enhanced.

Accordingly, the present invention provides an improved wall anchoring system that embodies the advantages and simplicity of prior anchors, while providing the further advantage of enhancing surface area contact for conduction and dissipation of heat from the refractory material to the support structure and ultimately the outside environment. This and other advantages of the present invention will be further explained and illustrated by the following description and drawings.

BRIEF DESCRIPTION OF THE DRAWINGS

This invention will be further illustrated by reference to the appended drawings which illustrate particular embodiments of the anchoring system of the present invention.

DETAILED DESCRIPTION OF THE PREFERRED EMBODIMENTS

It will be understood that the present invention can be implemented in a number of different ways, all within the spirit and scope of the claims appended hereto. The presently preferred embodiment of the invention will now be described.

Referring first to FIGS. 1–4, the present invention includes a first member (or fastening member) 10 that is adapted to be securable to a wall or other support structure for a kiln or other vessel, and a second member (or anchor or holding member) 30 configured to interconnect in a complementary manner with the first member 10 so that the surface area contact between the first member 10 and the second member 30 is enhanced to enhance heat transfer and heat dissipation, while at the same time allowing selected rotational movement of the members relatively to each other to be responsive to expansion and contraction of refractory material 40 held by the second member. In the preferred embodiment, this interrelationship between the members is accomplished by providing each member with an arcuate section and a corresponding arcuate cross-section such that the two members complementarily engage to permit relative rotational movement of the two members, while accentuating surface area contact between the two members.

Figure 1:
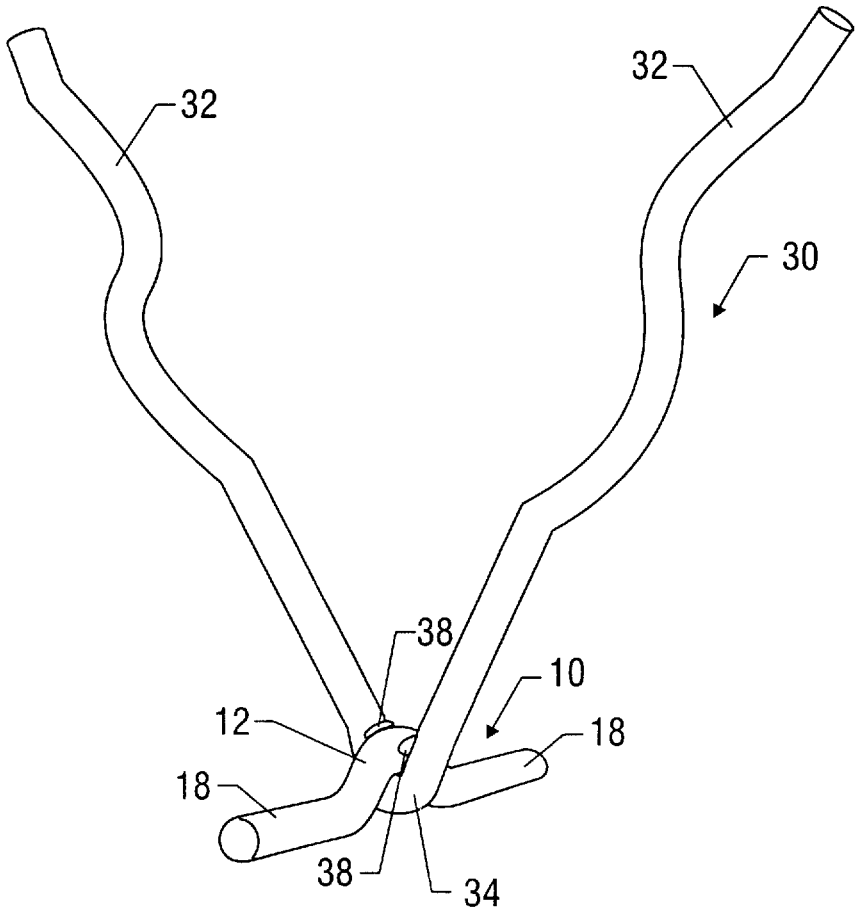
FIG. 1 is a perspective view of an anchor in accordance with the present invention.
Figure 2:
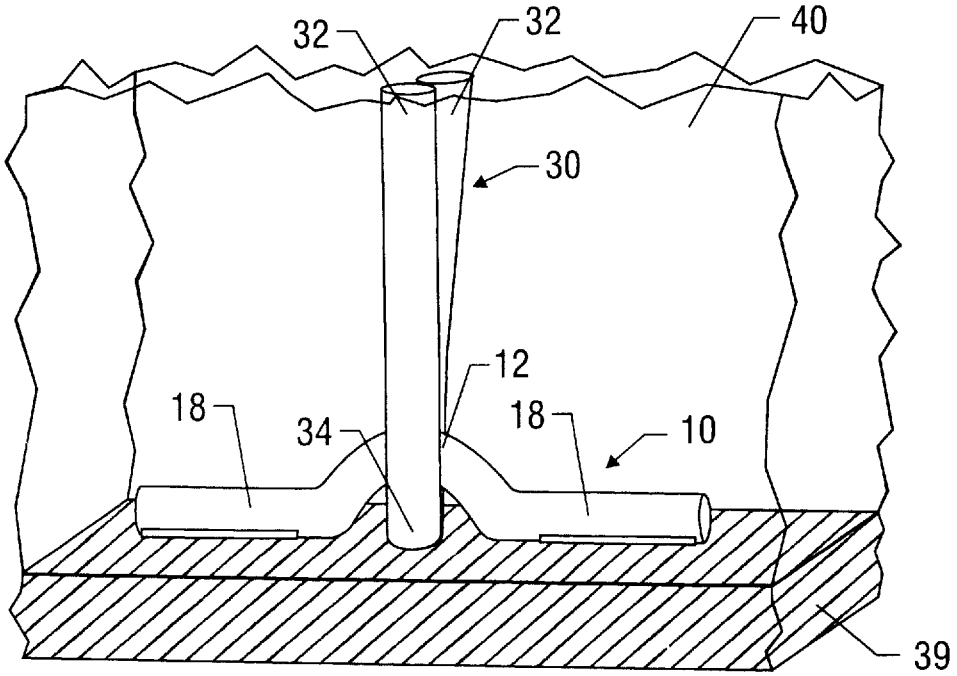
FIG. 2 is a side view of the anchor shown in FIG. 1 with the arms of the anchoring member truncated for ease of illustration.
Figure 3:
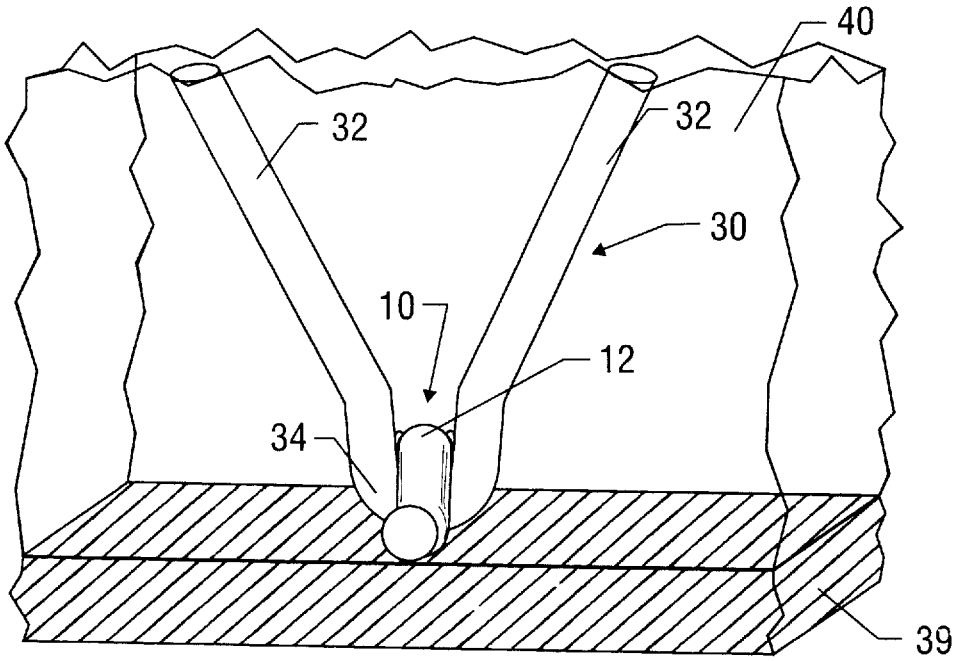
FIG. 3 is an end view of the anchor shown in FIGS. 1 and 2, again with the anchor extension arms shown in FIG. 1 being truncated for ease of illustration.
Figure 4:
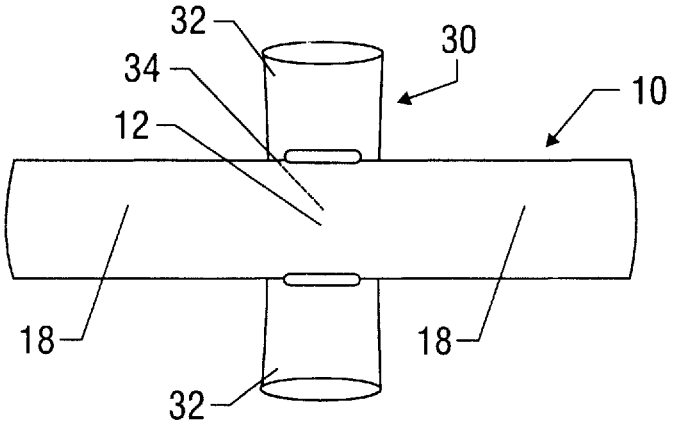
FIG. 4 is a top view of the anchor shown in FIGS. 1, 2 and 3, with the anchor extension arms again being truncated for ease of illustration.

Referring now specifically to FIGS. 1–4, in the preferred embodiment, the anchor of the present invention includes a first member (or fastening member) 10 that is adapted to be secured to a wall or other support structure 39 for a kiln or other vessel. The first member 10 includes a first section (or anchor engaging section) 12 having a selected arcuate shape of selected radius along its length as best shown in FIG. 2. In the preferred embodiment, the first section 12 of the first member 10 further has an arcuate shape in cross-section of selected radius or dimension as best shown in FIG. 3.

The first member may comprise a number of suitable configurations so long as it includes a suitably shaped first section for engaging with the second member as described in greater detail below and so long as it is adapted to be secured to a support structure in a manner that allows heat transfer through the first member. Additionally, the first member may be comprised of a number of suitable materials having the desired resistance to the temperatures to be encountered in the kiln and also having the ability to conduct heat. It is believed that the selection of such materials will be apparent from the present disclosure and thereby known to those of skill in the art.

Referring still to FIGS. 1–4, the anchor of the present invention also includes a second member (or anchor or holding member) 30 that is adapted to operatively interconnect with the first member 10 to connect refractory material 40 to a support structure for a kiln or other vessel. Referring specifically to FIG. 1, the second member 30 includes one or more refractory engaging members (or anchoring extension members) 32 having a shape, size, and length appropriate to be embedded within a layer of refractory material for a given application. The particular length and configuration of the refractory layer engaging members 32 may vary with each given application. Such features are not deemed to be critical to the present invention. The depiction of the members 32 in FIG. 1, therefore, represents only one possible embodiment for such members.

Referring again to FIGS. 1–4, the second member of the preferred embodiment also includes a complementary engaging section 34 having-an arcuate shape along its length that is complementary in shape and dimension to the arcuately-shaped cross-section of the first section 12 of the first member 10. In the preferred embodiment, the complementary engaging section 34 of the second or anchor member 30 further has an arcuate shape in cross-section of selected dimension slightly less than the arcuate shape of the first section 12 of the first member 10 so that the anchor engaging section (or first section) 12 of the first member 10 partially wraps around the complementary engaging section 34 of the second or anchor member 30 to provide complementary contact between the two. In this way, in the preferred embodiment, the radii of the cross-sections of the two members and the radii of the arcuate sections of the two members are selected to be complementary to allow relative rotational movement of the two members and to maximize surface area contact between the two members.

Additionally, in the preferred embodiment, the arcuate configuration of the first section 12 of the first member 10 and the cross section of the complementary engaging section 34 of the second member 30 are sized such that when the first member 10 is installed to a wall or supporting structure 39, the first member 10 holds the second member 30 in contact with the wall or supporting structure 39. This contact between the wall or supporting structure and the second member 30 further enhances the transfer of heat from the second member 30 of the anchor to the wall or supporting structure 39.

The provision of such a complementary relationship between the two members is believed to be advantageous for several reasons. First, as discussed above, it is believed that such a complementary arrangement will enhance contact between the two members and allow better heat dissipation. It is believed that enhancing heat dissipation will also increase the life of the anchor.

The complementary relationship between the two members also allows the anchor to move in all axes without stressing a single point. This is especially desirable in anchoring rotating equipment castable refractories because shrinkage in the castables allow slabs of castable to move independent of one another, which often causes anchors that cannot move without such stress to shear off at the shell or break the welds at the shells. This results in lining failure.

As with the first member 10, the second member 30 may be comprised of any of a number of materials suitable to withstand the heat to be encountered in the given application while providing the desired heat transfer properties for conducting such heat from the second member 30 to the first member 10. The selection of such materials will vary with the application and will be apparent to those of skill in the art from the present disclosure.

Referring again to FIGS. 1–4, the first member (or fastening member) 10 may further include a heat transfer section 18 connected to the anchor engaging section 12, wherein the heat transfer section 18 is adapted to be secured to a wall or other supporting structure 39 of a kiln or vessel. In the preferred embodiment, the heat transfer section 18 will typically be comprised of the same material as the rest of the first member 10. Additionally, for ease of manufacture, the heat transfer section will typically have a cross-sectional configuration consistent with the rest of the cross-sectional configuration of the first member 10. In an alternative aspect of the present invention, however, the heat transfer member 18 may be flattened to provide increased surface area contact with the wall or support structure to which it is fastened. As shown in FIG. 1, it is contemplated that the first member 10 will be attached to such a wall by welding or other suitable means.

Figure 5:
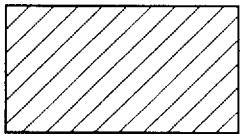
FIG. 5 shows an alternative cross-sectional configuration for members of the anchor shown in FIGS. 1–4.
Figure 6:
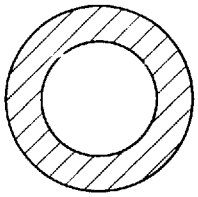
FIG. 6 illustrates an alternative cross-sectional configuration for the members of the anchor shown in FIGS. 1–4.

In the preferred embodiment, it is contemplated that both the first member 10 and second member 30 will be solid cylindrical members appropriately shaped to provide the complementary configuration as described above. As will be appreciated in view of the present disclosure, however, alternative shapes might be utilized without significantly decreasing the effectiveness of the present invention. For example, as shown in FIG. 6, either the first member or the second member may be comprised of a tubular member such that the first member or second member has an annular shape in cross-section as shown in FIG. 6. Also, it may be desirable, for cost reasons, to construct the first member 10 or second member 30 out of flat bar having a rectangular cross-section such as is shown in FIG. 5. In such applications, it is anticipated that the first member 10 and second member 30 would be provided with arcuate configurations along their lengths as described above to provide the maximum contact and flexibility of movement in accordance with the present invention.

Additionally, in the preferred embodiment, if desired, the first member 10 and second member 30 may be tack welded together, for example, as shown by the welds 38 in FIG. 1. Such welds would be adapted to hold during manufacture and installation, but fail in response to shifting refractory material, if desired.

The instant invention has been disclosed in connection with specific embodiments. However, it will be apparent to those skilled in the art that variations from the illustrated embodiments may be undertaken without departing from the spirit and scope of the invention. Such variations will be apparent to those skilled in the art in view of the above disclosure and are within the spirit and scope of the invention.

As used in this specification and in the appended claims, it should be understood that the word "connect" or any derivative thereof, implies not only a direct, immediate connection between the two recited parts, but also embraces the various arrangements wherein the parts are operatively connected, although other elements may be physically located or eliminated between the connected parts. Further, the word "a" does not preclude the presence of a plurality of elements accomplishing the same function.

What is claimed is:

1. An anchor for connecting refractory material to a wall for a kiln or furnace, enabling relative movement and heat dissipation between the refractory material and the wall, comprising:

(a) a fastening heat conductive member securable to such a wall, the fastening member including an anchor engaging section having a selectively shaped cross-section, the anchor engaging section further being selectively configured along its length; and (b) an anchoring heat conductive member adapted to be embedded in such refractory material, the anchoring member having a complementary engaging section engaging the anchor engaging section of the fastening member and positioned between refractory engaging members having free ends, the complementary engaging section of the anchoring member having a cross-sectional shape and dimension complementary to the selective configuration of the length of the anchor engaging section of the fastening member, the complementary engaging section of the anchoring member further having a selective configuration along its length complementary in shape and dimension to the selective cross-sectional shape of the anchor engaging section of the fastening member, such that surface area contact and heat transfer between the two engaging sections is enhanced, and such that rocking and rotational movement of the anchoring member is permitted relative to the fastening member.

2. An anchor for connecting refractory material to a wall for a kiln or furnace, enabling relative movement and heat dissipation between the refractory material and the wall, comprising:

(a) a fastening heat conductive member securable to such a wall, the fastening member including an anchor engaging section having a selected arcuate shape of selected radius along its length, the anchor engaging section of the fastening member further having an arcuate shape in cross-section of selected dimension; and (b) an anchoring heat conductive member adapted to be embedded in such refractory material, the anchoring member including a complementary engaging section engaging the anchor engaging section of the fastening member and positioned between refractory engaging members having free ends the complementary engaging section of the anchoring member having an arcuate shape along its length having a radius slightly greater than the selected dimension of the arcuate shape in cross-section of the anchor engaging section of the fastening member so that the complementary engaging section of the anchoring member partially wraps around the anchor engaging section of the fastening member, the complementary engaging section of the anchoring member further having an arcuate shape in cross-section having a radius slightly less than the selected radius of the arcuate shape of anchor engaging section of the fastening member so that the anchor engaging section of the fastening member partially wraps around the complementary engaging section of the anchoring member such that surface area contact and heat transfer between the two engaging sections is enhanced, and such that rocking and rotational movement of the anchoring member is permitted relative to the fastening member.

3. An anchor for connecting refractory material to a wall for a kiln or furnace, enabling relative movement and heat dissipation between the refractory material and the wall, comprising:

(a) a fastening heat conductive member securable to the wall, the fastening member having an anchor engaging section having a cross-sectional shape that is arcuate on one side to provide an anchor engaging surface area, the anchor engaging section further being arcuate along its length; and (b) an anchoring heat conductive member adapted to be embedded in the refractory material, the anchoring member having a complementary engaging section engaging the anchor engaging section of the fastening member and positioned between refractory engaging members having free ends, the complementary engaging section of the anchoring member having a cross-sectional shape and dimension complementary to the arcuate shape of the length of the anchor engaging section of the fastening member and the complementary engaging section further having an arcuate shape along its length complementary in shape and dimension to the cross-sectional shape of the anchor engaging section of the fastening member, such that surface area contact and heat transfer between the two engaging sections is enhanced, and such that rocking and rotational movement of the anchoring member is permitted relative to the fastening member.

4. The anchor of claim 3, wherein said fastening member has an annular cross section.

5. The anchor of claim 3, wherein said fastening member has a circular cross-section.

6. The anchor of claim 3, wherein said fastening member includes a heat transfer section connected to the anchor engaging section, said heat transfer section being adapted to be secured to a wall of a kiln or furnace.

7. The anchor of claim 3, wherein said fastening member is fixedly attached to the wall of the kiln or furnace.

8. The anchor of claim 3, further comprising a fail-safe member adapted to hold the anchoring member in fixed relation to the fastening member during manufacture and installation but also adapted to fail upon shifting of the refractory material.

9. The anchor of claim 8, wherein said fail-safe member comprises a tack weld.

10. The anchor of claim 3, wherein said refractory engaging members extend divergently away from said complementary engaging section and into said refractory material.

11. The anchor of claim 10, wherein said anchoring member comprises two refractory engaging members.

12. An anchor for connecting refractory material to a wall for a kiln or furnace, enabling relative movement and heat dissipation between the refractory material and the wall, comprising:

(a) a fastening heat conductive member securable to the wall, the fastening member having an anchor engaging section of circular cross-section and arcuate shape along its length;

(b) an anchoring heat conductive member adapted to be embedded in such refractory material, the anchoring member including a complementary engaging section engaging the anchor engaging section of the fastening member and positioned between refractory engaging members having free ends, the complementary engaging section of the anchoring member having a circular cross-section and arcuate shape along its length that complementarily interacts with the anchor engaging section of the fastening member, such that surface area contact and heat transfer between the two engaging sections is enhanced, and such that rocking and rotational movement of the anchoring member is permitted relative to the fastening member.

13. The anchor of claim 12, wherein said fastening member is fixedly attached to the wall of the kiln or furnace.

14. The anchor of claim 12, further comprising a fail-safe member adapted to hold the anchoring member in fixed relation to the fastening member during manufacture and installation but also adapted to fail upon shifting of the refractory material.

15. The anchor of claim 14, wherein said fail-safe member comprises a tack weld.

16. The anchor of claim 12, wherein said refractory engaging members extend divergently away from said complementary engaging section and into said refractory material.

17. The anchor of claim 16, wherein said anchoring member comprises two refractory engaging members.

18. The anchor of claim 17, wherein each of said refractory engaging members is selectively shaped and configured to comprise one or more arcuately-shaped segments along its length.

* * * * *